United States Patent [19]

Akkala et al.

[11] Patent Number: 4,953,510

[45] Date of Patent: Sep. 4, 1990

[54] APPARATUS AND METHOD FOR HEATING WATER

[75] Inventors: Marc W. Akkala, New Berlin; Kenneth R. Walther, Milwaukee, both of Wis.

[73] Assignee: A. O. Smith Corporation, Milwaukee, Wis.

[21] Appl. No.: 395,031

[22] Filed: Aug. 17, 1989

[51] Int. Cl.[5] ..... F22B 5/00

[52] U.S. Cl. ..... 122/17; 122/44.2; 122/155.2

[58] Field of Search ..... 122/44 A, 17, 155 A, 122/367; 110/326; 138/38

[56] References Cited

U.S. PATENT DOCUMENTS

| | | | |
|---|---|---|---|
| 600,910 | 3/1898 | Elemendorf | 122/44 A |
| 3,170,511 | 2/1965 | Guthrie | 122/17 |
| 3,492,972 | 2/1970 | McLaren | 122/17 |
| 4,157,706 | 6/1979 | Gaskill | 122/155 A |
| 4,559,998 | 12/1985 | Counterman | 122/44 A |
| 4,817,564 | 4/1989 | Akkala et al. | 122/17 |
| 4,850,336 | 7/1989 | Hagan | 122/155 A |

*Primary Examiner*—Edward G. Favors
*Assistant Examiner*—Denise L. Ferensic
*Attorney, Agent, or Firm*—Niro, Scavone, Haller & Niro, Ltd.

[57] ABSTRACT

Disclosed is an improved water heater and method of heating water retained in a storage tank having a flue passing through it. The apparatus and method directs hot gases flowing upwardly along the flue toward the flue's wall when heat transfer between those gases and the water is desired. The apparatus and method also directs the air or gases flowing upwardly within the flue away from the flue's wall when heat transfer is undesirable. The apparatus includes a plurality of moveable flow control fins secured at various locations along the length of a baffle by supported iwthin the flue. Each fin is secured to the baffle by a piece bi-metallic material whose shape changes in response to its temperature. When hot gases flow through the flue during a water heating mode, the bi-metallic pieces position the fins near the middle of the flue along the baffle's length and direct the flow of hot gases outwardly toward the flue's wall. When relatively hot gases are not passing through the flue and the only gas or air flow in the flue is that associated with a pilot burner, for example, the bi-metallic pieces sense the relatively cooler gas/air flow and position the fins near the flue's wall where they obstruct flow along the wall and direct it along the central axis portion of the baffle.

16 Claims, 2 Drawing Sheets

APPARATUS AND METHOD FOR HEATING WATER

BACKGROUND OF THE INVENTION

1. Field of the Invention

The present invention relates generally to heat exchanging apparatus and, more particularly, to water heaters.

2. Description of the Prior Art

The most common type of water heater presently in use consists of a storage tank for retaining heated water combined with some means for heating the water. Perhaps the most common means for heating the stored water is that in which a hot flame, produced by gas, for example, causes hot gases, including the combustion products, to rise through an elongated flue passing through the central portion of the storage tank. In this particular type of water heater the hot gases flowing up the flue contact its inner surface while the water within the storage tank is in contact with the flue's outer surface. While combustion continues, the water within the storage tank is heated by thermal conduction through the wall of the flue. In this type of water heater, an elongated baffle generally is disposed within the flue, about its center and along its length, to increase the efficiency of heat transfer from the hot gases through the wall of the flue to the water within the storage tank. Generally, this type of water heater includes a thermally activated valve that halts a combustion or main burner when the temperature of the water within the storage tank reaches a pre-established temperature.

To reduce heat loss from the water heater both while the water is being heated and after combustion has been cut off, the exterior surface of the storage tank is typically covered with a thermal insulating material. However, the inner surface of the flue cannot be thermally insulated because it would inhibit heat transfer while the water is being heated. Unfortunately, once the water becomes heated and the main burner combustion stops, heat from the water is transferred back through the wall of the flue and heats the upwardly flowing air and gas within the flue associated with a pilot burner, for example, or induced air flow from the room area surrounding the heater. This heating of the air within the flue is a significant source of heat loss in water heaters and, consequently, reduces their efficiency and increases their operating cost.

In most water heater installations, a vent pipe connects to the upper outlet of the flue outside of the water heater to conduct combustion products out of the building in which the heater is located. One technique for reducing heat loss from water heaters due to heating of the air within the flue during intervals when there is no combustion is the installation of a temperature responsive damper in this vent pipe. Examples of different types of such temperature responsive vent dampers are set forth in U.S. Pat. Nos. 3,197,139, 4,294,401, 4,337,892 and 4,384,671. However, because the flue's vent pipe must remain at least partially open for venting combustion products from the water heater's pilot which burns continuously whether or not water is being heated, the various devices disclosed in the preceding patents cannot completely block the flue's vent pipe to cut off all air and gas flowing through the flue.

SUMMARY OF THE INVENTION

An object of the present invention is to provide increased efficiency in a gas water heater having a continuously burning pilot.

Another object of the present invention is to reduce heat loss from a water heater during intervals in which water is not being heated.

Another object of the present invention is to increase heat transfer to the water in a water heater's storage tank during intervals in which the water is being heated.

Yet another object of the present invention is to provide a water heater that is cost effective in implementing the present invention.

Briefly, in its preferred embodiment, the present invention is an improved water heater which includes flow control means for directing the flow of gas and air that pass through the water heater's flue. The means for controlling the flue flow directs hot gases flowing along the flue toward the flue's inner surface when heat transfer between those gases and the water is desired. The means for controlling the flow also directs the gas and air within the flue away from the flue's inner surface when combustion is cut off and heat transfer is undesirable.

In its preferred embodiment, the means for controlling the flow consists of a plurality of moveable flow control fins secured at various locations along the length of the baffle supported within the flue. Each such flue is secured to the baffle by a piece of bi-metallic material whose shape or curvature changes in response to its temperature. These bi-metallic pieces are formed to position the fins near the middle of the flue along the baffle's length when hot gases are flowing through the flue. Thus disposed along the middle of the flue, the fins and bi-metallic pieces are adapted to direct the hot gases flowing through the flue toward the flue's inner surface. When there are no hot gases passing through the flue, the bi-metallic pieces position the fins near the flue's inner surface. Disposed adjacent to the flue's inner surface, the fins are adapted to direct any flow along the flue's length away from the flue's inner surface and to guide such flow along the baffle in the central portion of the flue.

An advantage of the present invention is that it increases a water heater's operating efficiency.

Another advantage is that it reduces a water heater's losses when water is not being heated.

Another advantage is that it increases heat transfer into the water in a water heater's storage tank when heating is desired.

Yet another advantage is that it reduces the cost of operating the water heater.

Still another advantage when the burner is not firing is that it increases the thickness of the gas flow boundary layer at the inside surface of the flue wall which tends to provide an insulating effect.

A further advantage when the burner is not firing is that the present invention adds a relatively large amount of restriction to the gas flow in order to limit the quantity of cool secondary air that flows through the flue.

Yet a still further advantage when the burner is not firing is that an axial flow through the flue is promoted which, being away from the flue wall, minimizes the convective condition along the flue wall.

These and other features, objects and advantages will be understood or apparent to those of ordinary skill in the art from the following detailed description of the preferred embodiments as illustrated in the various drawing figures.

DETAILED DESCRIPTION OF THE PREFERRED EMBODIMENT

Figure 1:
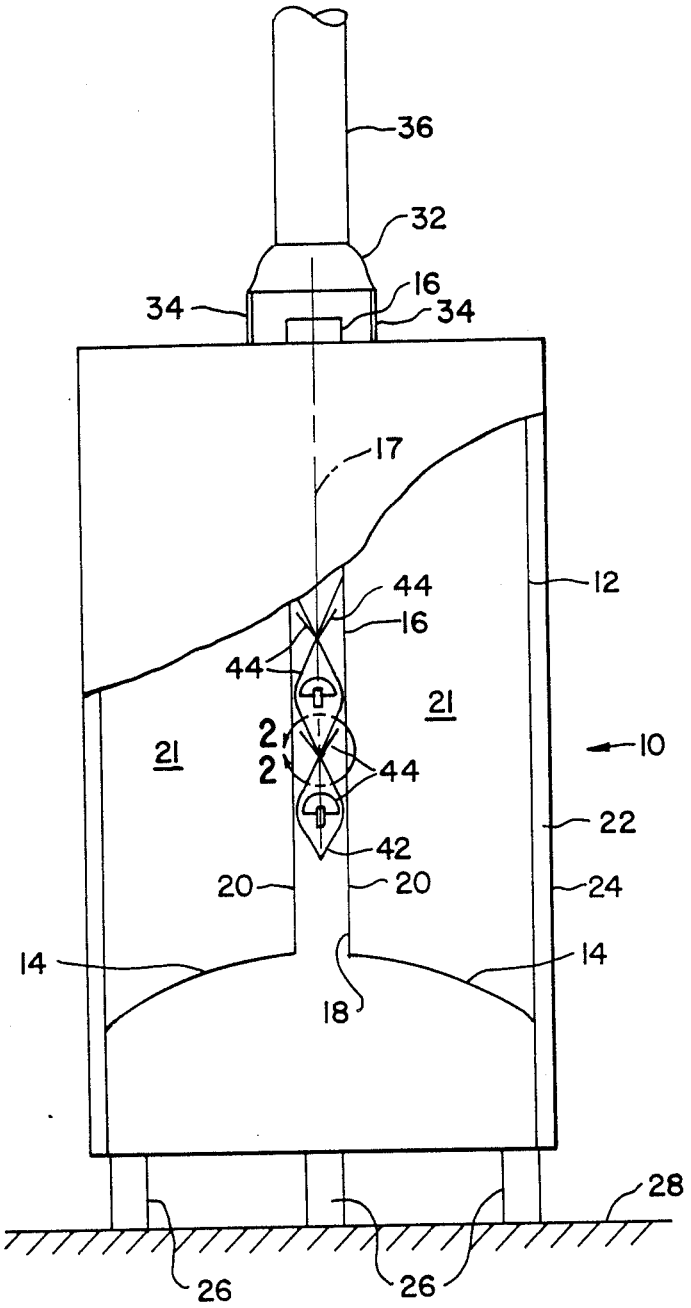
FIG. 1 depicts a partially sectioned water heater in accordance with the present invention including its flow directing fins.

FIG. 1 depicts a water heater in accordance with the present invention indicated by the general reference character 10. The water heater 10 includes a storage tank 12 having a bottom head 14. A cylindrically shaped flue 16 having a circular cross-sectional shape passes through the bottom head 14 and extends upward through the storage tank 12. The bottom head 14 is formed with a downward concave shape to guide hot gases into the flue 16. The flue 16 has a center-line 17 surrounded by an inner surface 18 which is contacted by gases within the flue 16. The flue 16 also has an outer surface 20 surrounding the center-line 17 of the flue 16. The outer surface 20 is contacted by water 21 retained within the storage tank 12. A conventional burner, not depicted in FIG. 1, is located in the space immediately beneath the bottom head 14 for producing hot gases. Also not depicted in FIG. 1, is a top head of the tank 12 through which the flue 16 also passes to project out of the top of the water heater 10. Thus, the flue 16 passes completely through the storage tank 12.

Immediately surrounding the sides and top of the surface tank 12 is a layer of insulation 22. An outer jacket 24 surrounds the insulation 22 to protect it from mechanical damage. Three legs 26 support the water heater 10 on top of a floor 28. The cold and hot water connections to the water heater 10 are not illustrated in FIG, 1 since they may be entirely conventional and are not in themselves relevant to this invention.

A draft hood 32 is supported above the top of the flue 16 by draft hood support legs 34. Projecting upward from the top of the draft hood 32 is a vent pipe 36. The draft hood 32 is formed with a downward concave shape to guide hot gases from the flue 16 into the vent pipe 36. The draft hood 32 is spaced above the top of the water heater 10 and of the flue 16 so the hot gases from the flue 16 may entrain additional air to create a good draft up the vent pipe 36.

Figure 2A:
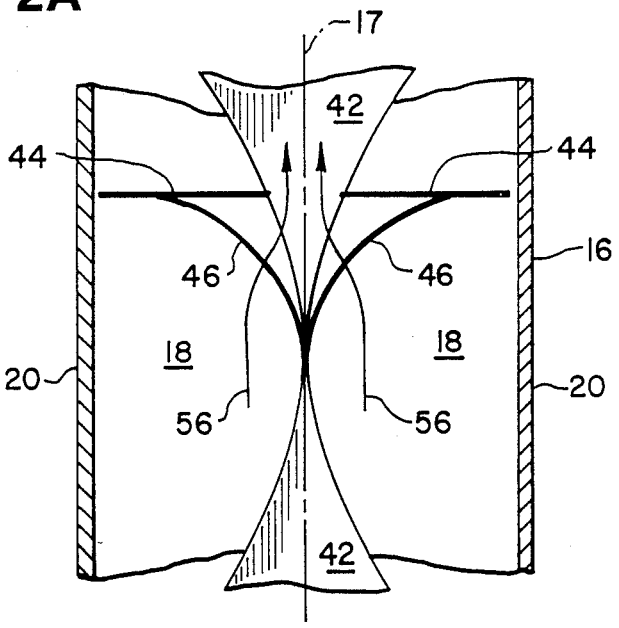
FIG. 2A is an enlargement of a portion of the water heater of FIG. 1 depicting its flow directing fins disposed to increase heat exchange.
Figure 2B:
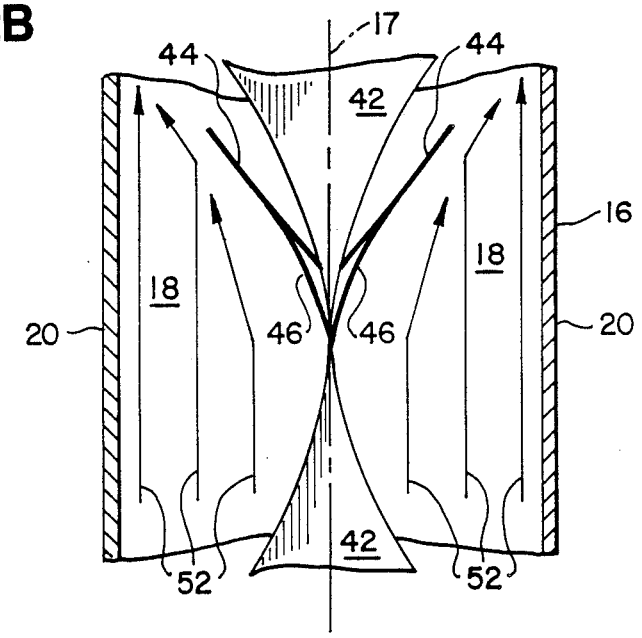
FIG. 2B is an enlargement of the same portion of the water heater of FIG. 1 as that of FIG. 2A but depicting the flow directing fins disposed to reduce heat exchange.

Supported within the flue 16 is an elongated, thin, serpentine shaped baffle 42. The baffle 42 is disposed about the center-line 17 of the flue 16 and extends vertically along the length of the flue 16. Referring now to FIGS. 2A and 2B in conjunction with FIG. 1, a short section of the flue 16 enclosing the serpentine baffle 42 is shown. Supported on opposite sides of the thin baffle 42 along its length are pairs of semi-circularly shaped fins 44. The fins 44 are individually secured to the baffle 42 by elongated, rectangularly shaped pieces 46 of bi-metallic material.

As illustrated in FIG. 2A, the bi-,metallic pieces 46 are formed so that when relatively hot gases from the main burner flow up the flue 16, the fins 44 retract away from the inner surface 18 of the flue 16 toward the baffle 42. The relatively hot gas flow is depicted by the arrows 52. Thus disposed almost vertically along the center-line 17 of the flue 16, the fins 44 direct the flow of hot gases outward toward the inner surface 18 of the flue 16. Thus, the fins 44 direct the hot gases toward the inner surface 18 of the flue 16 when maximum heat exchange is desired between the relatively hot gases within the flue 16 and water 21 surrounding the outer surface 20 of the flue 16.

As illustrated in FIG. 2B, the bi-metallic pieces 46 are formed so that when the relatively hot gases flowing up the flue 16 from the main burner subside (the main burner is off), the fins 44 extend horizontally outward from the baffle 42 toward the inner surface 18 of the flue 16. Disposed in this position away from the baffle 42, the semi-circularly shaped fins 44 are located immediately adjacent to the circularly shaped inner surface 18 of the flue 16. Thus disposed about the center-line 17 of the flue 16, the fins 44 direct any upward flow of gases (e.g. relatively cool gases from pilot flame and/or room air) inwardly away from the inner surface 18 of the flue 16 and toward the baffle 42 as indicated by the arrows 56. Thus disposed, the fins 44 obstruct the flow of gases along the inner surface 18 of the flue 16 thereby creating a stagnant layer of air along the inner surface 18 to, in effect, insulate the same. Thus, the fins 44 direct any flow of gases away from the inner surface 18 of the flue 16 when heat exchange between water 21 surrounding the outer surface 20 of the flue 16 and gases within the flue 16 is undesirable.

The effectiveness of the present invention has been tested by comparing the recovery efficiency, stand-by loss and energy factor among three water heaters 10 respectively having:

1. a standard baffle 42 without any fins 44;
2. a baffle 42 with only two fins 44 located near the top of the flue 16 to simulate the operation of the prior art temperature responsive vent dampers; and
3. a baffle 42 with two fins 44 located near the top of the flue 16, and 8 additional fins distributed along the length of the baffle 42. The following results were obtained for the preceding tests.

| Baffle Set-Up | Recovery Efficiency (%) | Stand-By Loss (%/hr) | Energy Factor |
|---|---|---|---|
| #1 | 70.76 | 4.64 | 0.4932 |
| #2 | 70.59 | 4.51 | 0.4996 |
| #3 | 73.00 | 3.79 | 0.5339 |

Although the present invention has been described in terms of the presently preferred embodiment, it is to be understood that such disclosure is purely illustrative and is not to be interpreted as limiting. Thus, while a bi-metallic material has been disclosed for the pieces 46 that secure the fins 44 to the baffle 42, a shape memory material such as nitinol (an alloy of nickel and titanium) could be used for the pieces 46. After proper forming and heat treatment, similar to bi-metallic materials, shape memory materials such as nitinol alter their shape in response to their temperature. Similarly, for a flue 16 having a non-circular cross-sectional shape, the fins 44 would not be formed with a semi-circular shape. Rather they would be formed with a shape to mate with the interior surface of such a non-circularly shaped flue 16.

The embodiment disclosed above includes a multiplicity of the moveable fins 44 disposed along the length of the flue. Of course, a number of benefits associated with the invention may be obtained if the moveable fins are not placed along the length of the flue. For example, a pair of the moveable fins could be disposed at the top of the flue only or two of the moveable fins could be disposed at the top of the flue and two moveable fins could be disposed at the bottom of the flue. In each case, varying degrees of improvement are recognized when the burner is not firing in regard to restricting or limiting the quantity of relatively cool secondary air which may flow through the flue while promoting axial flow through the flue to the extent that there is gas flow so as to minimize the convective condition along the flue wall. However, it is believed that the preferred embodiment dislcosed in the most effective implementation of the present invention in regard to addressing all heat transfer aspects of the limited gas flow through the flue when the water heater burner is not firing.

Consequently without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. An improved apparatus for exchanging heat between a first fluid retained within said apparatus and a second fluid flowing through said apparatus, said apparatus comprising:

a storage tank for retaining the first fluid, a flue means passing in heat exchange relationship with the first fluid in said storage tank, the first fluid being in heat transfer contact with a first surface of said flue means, and the second fluid flowing through said flue means being in heat transfer contact with a second surface thereof; and flow control means disposed within said flue means for directing said second flowing fluid toward said second surface of said flue means when heat exchange is desired between the first and second fluids, and for directing said second flowing fluid away from said second surface of said flue means when heat exchange between the first and second fluids is undesirable.

2. The apparatus of claim 1 further comprising a flow baffle disposed within said flue means.

3. The apparatus of claim 1 further comprising means for thermally insulating the outer surface of said storage tank.

4. The apparatus of claim 1 further comprising means for heating said second fluid prior to its flowing through said flue means.

5. The apparatus of claim 1 wherein said flow control means comprises at least one moveable temperature responsive fin for directing the flow of the second fluid.

6. An improved apparatus for exchanging heat between a first fluid retained within said apparatus and a second fluid flowing through said apparatus, said apparatus comprising:

a storage tank for retaining said first fluid;

a flue means passing in heat exchange relationship with said first fluid in said storage tank, said first fluid being in heat transfer contact with a first surface of said flue means, and said second fluid flowing through said flue means being in heat transfer contact with a second surface thereof; and flow control means disposed within said flue means including a moveable temperature responsive fin for directing said second flowing fluid toward said second surface of said flue means when heat exchange is desired between said first and second fluids, and for directing said second flowing fluid away from said second surface of said flue means when heat exchange between said first and second fluids is undesirable, said temperature responsive fin moving toward the center of said flue means when heat exchange is desired between said first and second fluids, and moving away from the center of said flue means when heat exchange between said first and second fluids is undesirable.

7. The apparatus of claim 5 further comprising a flow baffle supported within said flue means.

8. The apparatus fo claim 7 wherein said temperature responsive fin is secured to said flow baffle.

9. An improved apparatus for exchanging heat between a first fluid retained within said apparatus and a second fluid flowing through said apparatus, said apparatus comprising:

a storage tank for retaining said first fluid;

a flue means passing in heat exchange relationship with said first fluid in said storage tank, said first fluid being in heat transfer contact with a first surface of said flue means, and said second fluid flowing through said flue means being in heat transfer contact with a second surface thereof;

a flow baffle supported with said flue means generally along the center-line thereof; and flow control means disposed within said flue means including a temperature responsive fin secured to said flow baffle and moving toward said baffle when heat exchange is desired between said first and second fluids for directing said second flowing fluid toward said second surface of said flue means, and moving away from said flow baffle when heat exchange between said first and second fluids is undesirable for directing said second flowing fluid away from said second surface of said flue means.

10. An improved apparatus for exchanging heat between a first fluid retained within said apparatus and a second fluid flowing through said apparatus, said apparatus comprising:

a storage tank for retaining said first fluid;

a flue means passing in heat exchange relationship with said first fluid in said storage tank, said first fluid being in heat transfer contact with a first surface of said flue means, and said second fluid flowing through said flue means being in heat transfer contact with a second surface thereof;

a flow baffle supported within said flue means; and flow control means disposed within said flue means including a temperature responsive fin secured to said flow baffle by a piece of material whose shape changes in response to its temperature, said flow control means directing said second flowing fluid toward said second surface of said flue means when heat exchange is desired between said first and second fluids, and for directing said second flowing fluid away from said second surface of said flue means when heat exchange between said first and second fluids in undesirable.

11. The apparatus of claim 10 wherein said piece of material securing said temperature responsive fin to said flow baffle is formed from a bi-metallic material.

12. The apparatus of claim 10 further comprising means for thermally insulating the outer surface of said storage tank.

13. The apparatus of claim 10 further comprising means for heating the second fluid prior to its flowing through said flue means.

14. An improved method for exchanging heat between a first fluid retained within a storage tank, the storage tank having a flue means passing in heat exchange relationship therewith, and a second fluid, the method comprising the steps of:

contacting the first fluid retained in said storage tank with a first surface of said flue means;

directing a flow of the second fluid through said flue means so that the second fluid may contact a second surface of said flue means; and directing the second flowing fluid toward said second surface of said flue means when heat exchange is desired between the first and second fluids, and directing the second flowing fluid away from the second surface of said flue means when heat exchange between the first and second fluids is undesirable.

15. The method of claim 14 further comprising the step of heating the second fluid before said fluid passes through said flue means.

16. An improved apparatus for exchanging heat between a first fluid retained within said apparatus and a second fluid flowing through said apparatus, said apparatus comprising:

a storage tank for retaining the first fluid, a flue means passing in heat exchange relationship with the first fluid in said storage tank, the first fluid being in heat transfer contact with an outer surface of said flue means, and the second fluid flowing through said flue means being in heat transfer contact with an inner surface thereof; and flow control means disposed within said flue means for directing said second flowing fluid toward said inner surface of said flue means when it is desired to transfer heat to the first fluid which is relatively cold from the second fluid which is relatively hot, and for directing the second flowing fluid away from said inner surface of said flue means when heat exchange between the first and second fluids is undesirable due to a change in temperature of the second fluid, said flow control means comprising a flow baffle disposed within said flue means and a plurality of moveable temperature responsive fins for directing the flow of the second fluid in response to changes in the temperature of the second fluid, said fins being disposed at least in either the upper or lower portions of said flue.

* * * * *